US009353315B2

(12) United States Patent
Heath et al.

(10) Patent No.: US 9,353,315 B2
(45) Date of Patent: May 31, 2016

(54) VAPOR PROCESS SYSTEM

(76) Inventors: Rodney T. Heath, Farmington, NM (US); Forrest D. Heath, Katy, TX (US); Gary Heath, Farmington, NM (US)

( * ) Notice: Subject to any disclaimer, the term of this patent is extended or adjusted under 35 U.S.C. 154(b) by 1873 days.

(21) Appl. No.: 11/234,574

(22) Filed: Sep. 22, 2005

(65) Prior Publication Data

US 2006/0144080 A1 Jul. 6, 2006

Related U.S. Application Data

(60) Provisional application No. 60/612,278, filed on Sep. 22, 2004.

(51) Int. Cl.

| | |
|---|---|
| ***C10L 3/12*** | (2006.01) |
| ***C10G 5/06*** | (2006.01) |
| ***C10L 3/10*** | (2006.01) |

(52) U.S. Cl.

CPC ... *C10G 5/06* (2013.01); *C10L 3/10* (2013.01); *C10L 3/106* (2013.01); *C10L 3/12* (2013.01)

(58) Field of Classification Search

CPC ..... C10G 5/06; C10L 3/10; C10L 3/106; C10L 3/12

USPC ..... 62/617, 500; 95/237, 208, 192, 172, 95/175, 176, 177, 266, 247

See application file for complete search history.

(56) References Cited

U.S. PATENT DOCUMENTS

| | | | |
|---|---|---|---|
| 844,694 | A | 2/1907 | Smith |
| 1,903,481 | A | 4/1933 | Schweisthal |
| 2,225,959 | A | 12/1940 | Miller |
| 2,726,729 | A | 12/1955 | Williams |
| 2,738,026 | A | 3/1956 | Glasgow et al. |
| 2,765,872 | A | 10/1956 | Hartman et al. |
| 2,786,543 | A | 3/1957 | Hayes et al. |
| 2,812,827 | A | 11/1957 | Worley et al. |
| 2,815,901 | A | 12/1957 | Hale |
| 2,853,149 | A | 9/1958 | Gosselin |
| 2,937,140 | A | 5/1960 | Stinson |
| 2,970,107 | A | 1/1961 | Gilmore |
| 2,984,360 | A | 5/1961 | Smith |
| 3,018,640 | A | 1/1962 | Heller et al. |
| 3,025,928 | A | 3/1962 | Heath |
| 3,027,651 | A | 4/1962 | Nerge |
| 3,094,574 | A | 6/1963 | Glasgow et al. |

(Continued)

FOREIGN PATENT DOCUMENTS

| | | |
|---|---|---|
| AR | 011862 | 9/2000 |
| AR | 024366 | 10/2002 |

(Continued)

OTHER PUBLICATIONS

"Environmental Technology Verification Report", *Greenhouse Gas Technology Center Southern Research Institute.*

(Continued)

*Primary Examiner* — John F Pettitt

(74) *Attorney, Agent, or Firm* — Peacock Myers, P.C.; Deborah A. Peacock; Justin R. Jackson

(57) ABSTRACT

The present invention provides for a natural gas well vapor processing system and method comprising recovering gaseous hydrocarbons to prevent their release into the atmosphere including providing a method for preventing the gaseous hydrocarbons from returning to a liquid state.

6 Claims, 2 Drawing Sheets

(56) References Cited

U.S. PATENT DOCUMENTS 3,152,753 A 10/1964 Adams
3,182,434 A 5/1965 Fryar
3,232,027 A 2/1966 Lorenz et al.
3,237,847 A 3/1966 Wilson
3,254,473 A 6/1966 Fryar et al.
3,255,573 A 6/1966 Cox, Jr. et al.
3,288,448 A 11/1966 Patterson
3,321,890 A 5/1967 Barnhart
3,347,019 A 10/1967 Barnhart
3,360,127 A 12/1967 Wood, Jr.
3,396,512 A 8/1968 McMinn et al.
3,398,723 A 8/1968 Smalling
3,407,052 A * 10/1968 Huntress et al. ..... 48/127.3
3,528,758 A 9/1970 Perkins
3,540,821 A 11/1970 Siegmund
3,541,763 A 11/1970 Heath
3,589,984 A 6/1971 Reid
3,616,598 A * 11/1971 Floral ..... 203/18
3,648,434 A 3/1972 Gravis, III et al.
3,659,401 A 5/1972 Giammarco
3,662,017 A 5/1972 Woerner et al.
3,672,127 A 6/1972 Mayse et al.
3,736,725 A 6/1973 Alleman et al.
3,817,687 A 6/1974 Cavallero et al.
3,829,521 A * 8/1974 Green ..... 95/161
3,855,337 A 12/1974 Foral, Jr. et al.
3,872,682 A 3/1975 Shook
3,949,749 A 4/1976 Stewart
3,989,487 A 11/1976 Peterson
4,009,985 A 3/1977 Hirt
4,010,009 A 3/1977 Moyer
4,010,065 A 3/1977 Alleman
4,058,147 A 11/1977 Stary et al.
4,098,303 A 7/1978 Gammell
4,108,618 A 8/1978 Schneider
4,118,170 A 10/1978 Hirt
4,134,271 A 1/1979 Datia
4,162,145 A 7/1979 Alleman
4,165,618 A 8/1979 Tyree, Jr.
4,198,214 A 4/1980 Heath et al.
4,270,938 A 6/1981 Schmidt et al.
4,286,929 A 9/1981 Heath et al.
4,305,895 A 12/1981 Heath et al.
4,322,265 A 3/1982 Wood
4,332,643 A 6/1982 Reid
4,342,572 A 8/1982 Heath
4,362,462 A 12/1982 Blotenberg
4,369,049 A 1/1983 Heath
4,396,371 A 8/1983 Lorenz et al.
4,402,652 A 9/1983 Gerlach et al.
4,421,062 A * 12/1983 Padilla, Sr. ..... 122/1 R
4,431,433 A 2/1984 Gerlach et al.
4,435,196 A 3/1984 Pielkenrood
4,459,098 A 7/1984 Turek et al.
4,462,813 A 7/1984 May et al.
4,474,549 A 10/1984 Capone
4,474,550 A 10/1984 Heath et al.
4,493,770 A 1/1985 Moilliet
4,501,253 A 2/1985 Gerstmann et al.
4,505,333 A 3/1985 Ricks
4,511,374 A 4/1985 Heath
4,539,023 A 9/1985 Boley
4,568,268 A 2/1986 Gerlach et al.
4,579,565 A 4/1986 Heath
4,583,998 A 4/1986 Reid et al.
4,588,372 A 5/1986 Torborg
4,588,424 A 5/1986 Heath et al.
4,597,733 A 7/1986 Dean et al.
4,615,673 A 10/1986 Heath et al.
4,617,030 A 10/1986 Heath
4,659,344 A 4/1987 Gerlach et al.
4,674,446 A 6/1987 Padilla, Sr.
4,676,806 A 6/1987 Dean et al.
4,689,053 A 8/1987 Heath
4,701,188 A 10/1987 Mims
4,715,808 A 12/1987 Heath et al.
4,737,168 A 4/1988 Heath
4,778,443 A 10/1988 Sands et al.
4,780,115 A 10/1988 Ranke
4,824,447 A 4/1989 Goldsberry
4,830,580 A 5/1989 Hata et al.
4,919,777 A 4/1990 Bull
4,948,393 A 8/1990 Hodson et al.
4,949,544 A 8/1990 Hines
4,978,291 A 12/1990 Nakai
4,983,364 A 1/1991 Buck et al.
5,016,447 A 5/1991 Lane et al.
5,080,802 A 1/1992 Cairo, Jr. et al.
5,084,074 A 1/1992 Beer et al.
5,129,925 A 7/1992 Marsala et al.
5,130,078 A 7/1992 Dillman
5,132,011 A 7/1992 Ferris
5,163,981 A 11/1992 Choi
5,167,675 A 12/1992 Rhodes
5,191,990 A 3/1993 Fritts
5,195,587 A 3/1993 Webb
5,209,762 A 5/1993 Lowell
5,249,739 A 10/1993 Bartels et al.
5,269,886 A 12/1993 Brigham
5,346,537 A 9/1994 Lowell
5,377,723 A 1/1995 Hilliard
5,419,299 A 5/1995 Fukasawa et al.
5,453,114 A 9/1995 Ebeling
5,476,126 A 12/1995 Hilliard et al.
5,490,873 A 2/1996 Behrens et al.
5,501,253 A 3/1996 Weiss
5,513,680 A 5/1996 Hilliard et al.
5,536,303 A 7/1996 Ebeling
5,571,310 A 11/1996 Nanaji
5,579,740 A 12/1996 Cotton et al.
5,626,027 A 5/1997 Dormer et al.
5,664,144 A 9/1997 Yanai et al.
5,665,144 A 9/1997 Hill et al.
5,678,411 A 10/1997 Matsumura et al.
5,755,854 A 5/1998 Nanaji
5,766,313 A 6/1998 Heath
5,826,433 A 10/1998 Dube
5,857,616 A 1/1999 Karnoff et al.
5,878,725 A 3/1999 Osterbrink
5,882,486 A 3/1999 Moore
5,885,060 A 3/1999 Cunkelman et al.
5,988,232 A 11/1999 Koch et al.
6,004,380 A 12/1999 Landreau et al.
6,010,674 A 1/2000 Miles et al.
6,023,003 A * 2/2000 Dunning et al. ..... 568/868
6,027,311 A 2/2000 Hill et al.
6,095,793 A 8/2000 Greeb
6,142,191 A 11/2000 Sutton et al.
6,183,540 B1 2/2001 Thonsgaard
6,193,500 B1 2/2001 Bradt et al.
6,223,789 B1 5/2001 Koch
6,224,369 B1 5/2001 Moneyhun
6,238,461 B1 5/2001 Heath
6,251,166 B1 6/2001 Anderson
6,273,937 B1 * 8/2001 Schucker ..... 95/45
6,299,671 B1 10/2001 Christensen
6,314,981 B1 11/2001 Mayzou et al.
6,332,408 B2 12/2001 Howlett
6,363,744 B2 4/2002 Finn et al.
6,364,933 B1 4/2002 Heath
6,425,942 B1 7/2002 Forster
6,461,413 B1 10/2002 Landreau et al.
6,478,576 B1 11/2002 Bradt et al.
6,499,476 B1 12/2002 Reddy
6,532,999 B2 3/2003 Pope et al.
6,533,574 B1 3/2003 Pechoux
6,537,349 B2 3/2003 Choi et al.
6,537,458 B1 3/2003 Polderman
6,551,379 B2 4/2003 Heath
6,604,558 B2 * 8/2003 Sauer ..... 141/98
6,616,731 B1 9/2003 Hillstrom
6,719,824 B1 * 4/2004 Bowser ..... 95/50
6,745,576 B1 6/2004 Granger
6,931,919 B2 8/2005 Weldon

(56) References Cited

U.S. PATENT DOCUMENTS

| | | | |
|---|---|---|---|
| 6,984,257 | B2 | 1/2006 | Heath et al. |
| 7,005,057 | B1 | 2/2006 | Kalnes |
| 7,025,084 | B2 | 4/2006 | Perry et al. |
| 7,131,265 | B2 | 11/2006 | Lechner |
| RE39,944 | E | 12/2007 | Heath |
| 7,350,581 | B2 | 4/2008 | Wynn |
| 7,481,237 | B2 | 1/2009 | Jones et al. |
| 7,497,180 | B2 | 3/2009 | Karlsson et al. |
| 7,531,030 | B2 | 5/2009 | Heath et al. |
| 7,575,672 | B1 | 8/2009 | Gilmore |
| 7,791,882 | B2 | 9/2010 | Chu et al. |
| 7,905,722 | B1 | 3/2011 | Heath et al. |
| 8,529,215 | B2 | 9/2013 | Heath et al. |
| 8,840,703 | B1 | 9/2014 | Heath et al. |
| 8,864,887 | B2 | 10/2014 | Heath et al. |
| 8,900,343 | B1 | 12/2014 | Heath et al. |
| 2001/0008073 | A1 | 7/2001 | Finn et al. |
| 2002/0073843 | A1 | 6/2002 | Heath |
| 2002/0081213 | A1 | 6/2002 | Takahashi et al. |
| 2002/0178918 | A1 | 12/2002 | Lecomte et al. |
| 2002/0185006 | A1 | 12/2002 | Lecomte et al. |
| 2003/0005823 | A1* | 1/2003 | Le Blanc et al. ..... 95/149 |
| 2003/0167690 | A1 | 9/2003 | Edlund et al. |
| 2004/0031389 | A1 | 2/2004 | Heath et al. |
| 2004/0186630 | A1 | 9/2004 | Shier et al. |
| 2004/0211192 | A1 | 10/2004 | Lechner |
| 2005/0115248 | A1 | 6/2005 | Koehler et al. |
| 2005/0266362 | A1 | 12/2005 | Stone et al. |
| 2006/0156744 | A1 | 7/2006 | Cusiter et al. |
| 2006/0156758 | A1 | 7/2006 | An et al. |
| 2006/0218900 | A1 | 10/2006 | Lechner |
| 2006/0254777 | A1 | 11/2006 | Wynn |
| 2006/0260468 | A1 | 11/2006 | Amin |
| 2007/0051114 | A1 | 3/2007 | Mahlanen |
| 2007/0084341 | A1 | 4/2007 | Heath et al. |
| 2007/0151292 | A1 | 7/2007 | Heath et al. |
| 2007/0175226 | A1 | 8/2007 | Karlsson et al. |
| 2007/0186770 | A1 | 8/2007 | Heath et al. |
| 2007/0199696 | A1 | 8/2007 | Walford |
| 2008/0008602 | A1 | 1/2008 | Pozivil et al. |
| 2008/0120993 | A1 | 5/2008 | An et al. |
| 2009/0133578 | A1 | 5/2009 | Brasa et al. |
| 2009/0223246 | A1 | 9/2009 | Heath et al. |
| 2010/0040989 | A1 | 2/2010 | Heath et al. |
| 2010/0083678 | A1 | 4/2010 | Lifson et al. |
| 2010/0083691 | A1 | 4/2010 | Immink et al. |
| 2010/0263393 | A1 | 10/2010 | Chen et al. |
| 2010/0313586 | A1 | 12/2010 | Yakumaru et al. |
| 2012/0079851 | A1 | 4/2012 | Heath et al. |
| 2012/0261092 | A1 | 10/2012 | Heath et al. |
| 2013/0319844 | A1 | 12/2013 | Heath et al. |

FOREIGN PATENT DOCUMENTS

| | | |
|---|---|---|
| CA | 2426071 | 10/2003 |
| CA | 2281610 | 6/2004 |
| CA | 2224389 | 2/2008 |
| CA | 2311440 | 6/2011 |
| CA | 2563747 | 5/2013 |
| CA | 2523110 | 8/2014 |
| CA | 2541606 | 10/2014 |
| CA | 2809118 | 2/2015 |
| FR | 2542039 | 9/1984 |
| GB | 370591 | 4/1932 |
| GB | 573819 | 12/1945 |
| JP | 58185990 A | 10/1983 |
| RU | 2159913 | 11/2000 |
| SU | 1021809 | 6/1983 |
| SU | 1801092 | 3/1993 |
| WO | 2005/068847 | 7/2005 |
| WO | 2010/080040 | 7/2010 |
| WO | 2013/170190 | 11/2013 |

OTHER PUBLICATIONS

"Natural Gas Dehydration", *The Environmental Technology Verification Program*, (Sep. 2003).

Archer, Phil , "TEG Regenerator Vapor Recovery in Amoco's Northwesern Business Unit", (Aug. 1992).

Reid, Laurance S., "Coldfinger An Exhauster for Removing Trace Quantities of Water from Glycol Solutions Used for Gas Dehydration", *Ball-Reid Engineers, Inc., Oklahoma City, Oklahoma*, (1975),592-602.

* cited by examiner

VAPOR PROCESS SYSTEM

CROSS-REFERENCE TO RELATED APPLICATIONS

This application claims the benefit of the filing of U.S. Provisional Patent Application Ser. No. 60/612,278, entitled "Vapor Process System", filed on Sep. 22, 2004, and the specification of that application is incorporated herein by reference.

BACKGROUND OF THE INVENTION

1. Field of the Invention (Technical Field)

The present invention relates to vapor processing systems for use with natural gas wells. The invention comprises a pumping system used with an engine instead of plunger lifts and can be used to remove evolved gases from hydrocarbon liquids to storage at or near atmospheric pressure.

2. Background Art

In addition to producing natural gas, many natural gas wells produce hydrocarbon liquids and water. The liquids, hydrocarbons and water, are separated from the flowing natural gas by a separator installed in the line carrying the flowing gas stream. The inline separator may operate at pressures as high as 1,500 psig or as low as 30 psig. The inline separator may separate the separated liquids into hydrocarbon and water components. The separated water is dumped to disposal, and the separated hydrocarbons are dumped to storage. The storage for the separated hydrocarbons is generally a steel tank or tanks with each tank having a capacity of 200 to 500 barrels. The storage tanks may operate at pressures as high as 16 ounces per square inch above atmospheric pressure to as low as atmospheric pressure.

An intermediate pressure separator is often used on natural gas wells that are operating at elevated pressures (150 to 1,500 psig). The intermediate pressure separator may operate at pressures of 125 to 25 psig. The intermediate pressure separator receives the total separated liquid from the inline separator. The intermediate pressure separator separates the liquid into its components, hydrocarbons and water. As described above, the water is dumped to disposal and the hydrocarbons are dumped to storage. As a result of the reduction of pressure, the intermediate pressure separator also releases most of the entrained natural gas from the separated hydrocarbons. Without a means to recover the entrained natural gas or a means designed to collect and burn the entrained natural gas, the entrained natural gas released in the intermediate pressure separator will be vented to the atmosphere and wasted. In most systems designed to collect and burn the entrained natural gas, the heat energy released by burning the natural gas is wasted to the atmosphere. A means is needed to prevent entrained natural gas from being released to the atmosphere.

Because of the reduction in pressure from the intermediate pressure separator to the storage tank, the liquid hydrocarbons dumped to the storage tanks will release additional entrained natural gas, and any component of the natural gas liquids that is not stable at the storage tank pressure and temperature will begin to evolve from the hydrocarbon liquids and change from a liquid to a gaseous state. The changing in the storage tank of hydrocarbon liquids from a liquid to a gaseous state is commonly referred to as "weathering". Again, without a system to either recover or burn the gases released from the hydrocarbon liquids dumped to the storage tank, the gases will vent to the atmosphere and be wasted. The gases released from the storage tank are a high BTU value of approximately 3,000 BTU per cubic foot compared to the standard of 1,000 BTU per cubic foot required for residential gas. A means is needed to prevent gases released from liquid hydrocarbons from being released to the atmosphere.

For many years, systems have been made available to collect the gaseous hydrocarbons that are released from liquid hydrocarbons separated at elevated pressures and then transferred to storage tanks operating at near atmospheric pressure. In addition to operating problems that can occur with the currently available recovery systems, the biggest problem that has limited their application has been capital cost, and the systems have generally been applied to gas wells that have operated at pressures of 250 psig or less and that have produced volumes of hydrocarbon liquids in the range of 100 barrels per day or more.

Natural gas wells that can produce 100 barrels per day or more of hydrocarbon liquids do not generally require any type of artificial lift to lift the liquid hydrocarbons to the surface. In most cases, smaller volume natural gas wells do require artificial lift to lift the liquid hydrocarbons to the surface. A widely used artificial lift systems is called a "plunger lift". The plunger is a metal device that falls to the bottom of the natural gas well tubing while the gas flow is shut off at the surface. The plunger remains at the bottom of the tubing for a period of time while the gas well builds up enough pressure to provide enough gas flow to bring to the surface the plunger and the load of liquid hydrocarbons the plunger is lifting. When the gas well is again opened, the plunger and liquid hydrocarbons rise to the surface. Often, the liquid hydrocarbons arrive at the surface as a slug that is much larger than the normal hydrocarbon liquid production of the well. The liquid hydrocarbon slug can create a volume of flash and evolved gases that will overload the vapor recovery system.

On natural gas wells where the plunger lift or other types of artificial lift creates a slugging condition that overloads the vapor recovery system, a pumping system developed by Unico, Inc. ("Unico") can be used to lift the produced liquid hydrocarbons to the surface. Up until now, pumping of natural gas wells has been avoided because of pumping problems. Some of the problems with pumping gas wells have been gas locking (a condition where the pumping barrel fills with gas and no fluid can be pumped), gas interference (a condition where the pumping barrel only partially fills with fluid each stroke of the pump), and fluid pounding (a condition where the downward stroke of the pump contacts the fluid in a less than fluid filled barrel). The Unico pumping system presents a solution to the problems of pumping gas wells by only pumping the amount of fluids the well is producing. Pumping only the amount of fluids the well is producing prevents "pump-off" (a condition where the well bore is pumped dry thereby allowing gas to enter the pump barrel). A method is needed to eliminate gas entering the pump barrel to eliminate the problems associated with pumping natural gas wells.

BRIEF SUMMARY OF THE INVENTION

An embodiment of the present invention provides for a natural gas well vapor processing system and method comprising recovering gaseous hydrocarbons to prevent their release into the atmosphere including providing a method for preventing the gaseous hydrocarbons from returning to a liquid state.

In one embodiment of the present invention, evolved gases are entrained at the vacuum port of an eductor into a fluid stream and compressed. The fluid flowing through the eductor discharges into an emissions separator where the compressed gases separate from the fluid, and the compressed gases flow to the outlet of the emissions separator to be further processed while the fluid falls to the bottom of the emissions separator. The fluid collects in the bottom of the emissions separator to provide a continuous closed circuit fluid feed to the suction of a circulating pump.

The emissions separator also receives entrained gas that evolves from hydrocarbon liquids when the liquids are separated from a flowing gas stream at higher pressure and dumped to the lower pressure of an intermediate pressure separator. In the emissions separator, the two gases mix to form a homogeneous mixture. The homogeneous gas mixture flows from the outlet of the emissions separator to the suction of a gas compressor where the gases are compressed to the pressure of the flowing gas stream. The compressed gases are discharged back into the flowing gas stream at the inlet to the inline separator where the compressed gases mix with the flowing gas stream to form, in the inline separator, a second homogeneous gaseous mixture. The second homogeneous gas mixture flows from the outlet of the inline separator to other processing or to points of sale.

Another embodiment provides for mixing a high BTU and vapor pressure gas with a lower BTU and vapor pressure gas flowing in the pipeline to reduce the BTU and partial pressure of the compressed gas while at the same time slightly raising the BTU and partial pressure of the flowing gas stream. Lowering the BTU and partial pressure of the compressed gases reduces the tendency of the gases evolved and recovered from the tank to return to a liquid state. Any of the compressed gases that return back to a liquid state prior to passing out of the inline separator are again separated and dumped back to the storage tank.

Thus, an embodiment of the present invention provides a method for preventing the release of natural gas in a natural gas well processing system from entering the atmosphere comprising, collecting evolved gases from a storage tank, entraining the evolved gases into a fluid stream, compressing the evolved gases and fluid stream, sending the evolved gases and fluid stream to an emissions separator, and separating the gases from the fluid for further processing. Preferably, the evolved gases are collected using a vacuum, and preferably, the method further comprises providing an eductor to create the vacuum and to entrain the gasses into the liquid stream. The method preferably further comprises mixing a first compressed gas with a second compressed gas flowing in a pipeline, the second compressed gas having a BTU lower relative to the BTU of the first compressed gas to prevent gaseous hydrocarbons in the natural gas well processing system from entering a liquid state.

Another embodiment provides a method for preventing the release of gaseous hydrocarbons at a natural gas well processing system from entering the atmosphere, the method comprising providing an emissions separator, sending to the emissions separator the entrained gases that evolve form hydrocarbon liquids when the liquids are separated from a flowing gas stream at higher pressure and put in the lower pressure of an intermediate separator, sending the gaseous hydrocarbons to a compressor and compressing the gaseous hydrocarbons, and sending the compressed gaseous hydrocarbons to a flowing gas stream for further processing or point of sale.

Another embodiment provides a natural gas well processing system comprising a hydrocarbon storage tank, an eductor linked to the storage tank to receive gasses that evolve in the storage tank, entrain said gasses into a fluid stream, and compress the gasses and said fluid stream, and an emissions separator linked to the eductor for receiving the evolved gases and fluid stream for separation of the gasses from the fluid stream and for sending the gasses out of the emissions separator for further processing.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
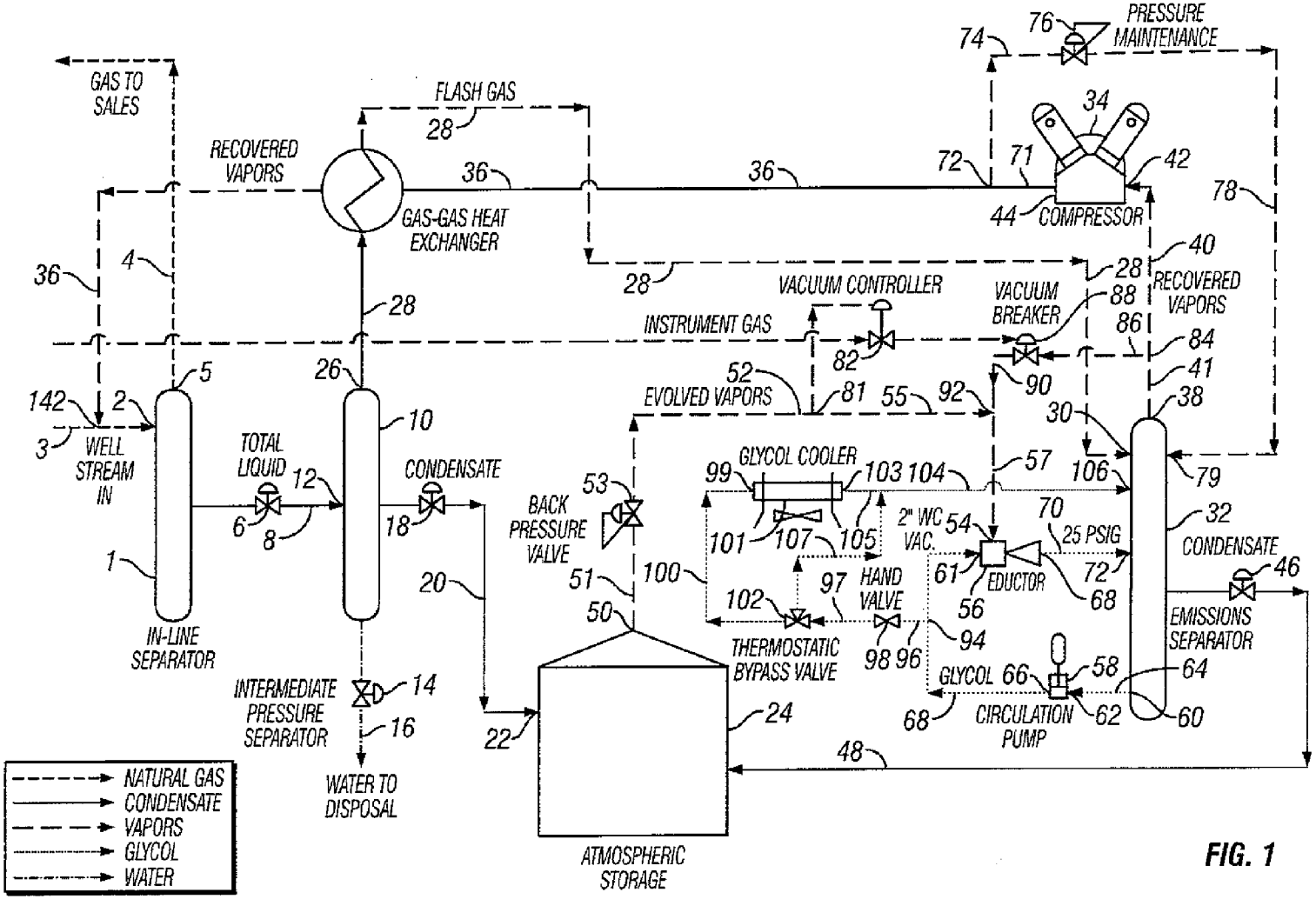
FIG. 1 is a flow diagram of an embodiment of the invention.

The present invention provides a pumping system to replace plunger lifts used on natural wells. For example, in one embodiment, the pumping system such as that disclosed and marketed by Unico, Inc. ("Unico") (or other appropriate) pumping system can be used with an engine such as that provided by Marathon Engine Systems (or other appropriate engine) to replace plunger lifts on natural gas wells. Replacing the plunger lift increases a well's production time by eliminating the lost production time associated with shutting down the well to allow the plunger to fall to the bottom as well as eliminating the lost production time required for the well to build up enough pressure to cause the plunger to rise to the surface. Often, the lost production time is greater than a well's production time. Besides increasing a well's production time, the Unico pumping system further increases a well's production by lowering the pressure the producing formation is producing against. The fluids produced by the well are pumped up through the tubing, and the gas is produced out the casing, eliminating the pressure deferential between the casing and tubing required to produce both the fluids and gas up through the tubing.

An embodiment of the present invention provides an economical system for use on natural gas wells that produce a small volume of hydrocarbon liquids (5 to 50 barrels per day), although the present invention can also be used for larger volumes. The system collects and returns the gaseous hydrocarbons to a gas stream flowing at 250 psig or less, the gaseous hydrocarbons released as a result of separating liquid hydrocarbons from the flowing gas stream and transferring to, and storing in, tanks, at near or atmospheric pressure, the separated liquid hydrocarbons.

In an embodiment of the present invention, an engine generator set such as, for example, a 7.5 horsepower engine generator set (e.g. a generator set such as supplied by Marathon Engine Company), is used to provide the power to operate the gas recovery system. The engine generator set powers electric motors (for example, two electric motors). One electric motor powers a circulating pump to provide fluid energy to power an eductor that creates a vacuum to collect evolved gases from the storage tanks. The evolved gases are entrained at the vacuum port of the eductor into the fluid stream and compressed to a maximum of, for example, 30 psig. The fluid flowing through the eductor discharges into an emissions separator where the compressed gases separate from the fluid and the compressed gases flow to the outlet of the emissions separator to be further processed while the fluid falls to the bottom of the emissions separator. The fluid collects in the bottom of the emissions separator to provide a continuous closed circuit fluid feed to the suction of a circulating pump.

The emissions separator also receives entrained gas that evolves from hydrocarbon liquids when the liquids are separated from a flowing gas stream at higher pressure and dumped to the lower pressure of an intermediate pressure separator. On most installations, the intermediate pressure separator and the emissions separator operate at the same pressure (e.g. 30 psig or less), but on some installations it is desirable to use a back pressure to hold the intermediate pressure separator at a higher pressure than the operating pressure of the emissions separator. In the emissions separator, the two gases (one at, for example, approximately 3,000 BTU per cubic foot from the storage tanks and the other at, for example, approximately 2,000 BTU per cubic foot from the intermediate pressure separator) mix to form, for example, an approximately 2,500 BTU per cubic foot homogeneous mixture. The 2,500 BTU homogeneous gas mixture flows from the outlet of the emissions separator to the suction of a small capacity, conventional, reciprocating, gas compressor where the gases are compressed to the pressure of the flowing gas stream (e.g. 250 psig or less). The compressed gases are discharged back into the flowing gas stream at the inlet to the inline separator where the compressed gases mix with the flowing gas stream to form, in the inline separator, a second homogeneous gaseous mixture. The second homogeneous gas mixture flows from the outlet of the inline separator to other processing or to points of sale.

Mixing the relatively small volume of high BTU and vapor pressure gas (e.g., approximately 2,500 BTU per cubic foot compressed gas) with the larger volume of lower BTU and vapor pressure gas (e.g., approximately 1,000 BTU per cubic foot gas) flowing in the pipeline greatly reduces the BTU and partial pressure of the compressed gas while at the same time slightly raising the BTU and partial pressure of the flowing gas stream. Lowering the BTU and partial pressure of the compressed gases reduces the tendency of the gases evolved and recovered from the tank to return to a liquid state. Any of the compressed gases that return back to a liquid state prior to passing out of the inline separator are again separated and dumped back to the storage tank. The physical process of gases evolving from hydrocarbon liquids stored at low pressure, the gases being compressed to a higher pressure, then, after compression, the gases changing state from a gas back to a liquid, and, again, the liquid being dumped back to low pressure storage to begin evolving into a gas again, greatly increases the compressor horsepower required to recover evolved gases. The higher the flowing line pressure, the more gases that will be evolved when hydrocarbon liquids are separated from a flowing gas stream and then dumped from the higher pressure to a lower pressure Also, the higher the flowing line pressure, the greater is the tendency for the evolved gases from liquid hydrocarbons, dumped from a higher pressure to a lower pressure, to change from a gaseous state back to a liquid state when the gases are collected and compressed back to the higher pressure.

The tendency of hydrocarbon liquids to change state from liquids to gases and then back to liquid again can create what are commonly called "recycle loops". At times, the recycle loops can become large enough to force the required compressor horsepower needed to recover the evolved gases to become infinite and a simple vapor recovery system cannot be used. The "Hero" system described in U.S. Pat. No. 4,579,565, was designed to address applications where simple vapor recovery was not practical.

Another object of the present invention is to provide a process that allows the use, with some modifications, of the previously described components of the simple vapor recovery system to collect the evolved gases from hydrocarbon liquids separated at pressures as high as, for example, 500 to 1,000 psig and then dumped to storage at, or near, atmospheric pressure. As previously described, without modifications to the process, the simple vapor recovery system can develop, at high flowing gas pressures, recycle loops that could cause the horsepower required by the recovery system to become infinite.

To decrease the tendency of gases evolved from hydrocarbon liquids separated at high pressure, dumped to storage at low pressure, collected at low pressure, and then, again, compressed back to high pressure to change state from a gas to a liquid, the previously described simple vapor recovery system is modified in the embodiment of the present invention described below.

In one embodiment, the collected volume of high BTU gas forming the suction volume of any stage of the reciprocating compressor is increased by as much as 5% to 10% by introducing lower BTU line gas from the inline separator into the volume of collected suction gas. Changing the partial pressure of the homogenous gas mixture, by introducing lower BTU line gas into the higher BTU suction gas, decreases the tendency of the higher BTU suction gas to change state from a gas to a liquid when the homogenous gas mixture is compressed and cooled. In another embodiment, the temperature between stages of compression of the homogenous gas mixture is controlled to maintain the suction temperature of each stage of compression at approximately 100 to 120 degrees Fahrenheit. Both embodiments can be combined in one system.

Turning now to the figures, FIG. 1 is a flow diagram of the vapor system which accomplishes decreasing the tendency of the higher BTU suction gas to change state from a gas to a liquid. Referring to FIG. 1, line 3 comprises a flowing natural gas stream. The flowing natural gas stream in line 3 enters inline separator 1 at inlet 2. While flowing through inline separator 1, the free fluids, liquid hydrocarbons and water, are separated from the flowing natural gas. The flowing natural gas exits inline separator 1 at exit 5 and flows through line 4 to sales or other processing.

The free fluids fall to the bottom of inline separator 1 and are dumped through valve 6 (valve 6 is actuated by a liquid level control (not shown)) and flow through line 8 to enter intermediate pressure separator 10 at inlet 12. The free fluids fall to the bottom of intermediate separator 10. In the bottom of intermediate separator 10, the free fluids are separated by a conventional weir system into the free fluids components, liquid hydrocarbons and water. The water is dumped by valve 14 (valve 14 is actuated by a liquid level control (not shown)) and flows through line 16 to disposal. The liquid hydrocarbons are dumped through valve 18 (valve 18 is actuated by a liquid level control (not shown)) and flow through line 20 to the inlet 22 of storage tank 24. The changes to the liquids being dumped from intermediate separator 10 to storage tank 24 are described below.

The gas that flashes as a result of the liquid hydrocarbons being dumped from the higher pressure of inline separator 1 to the lower pressure of intermediate separator 10 form a first body of homogeneous gas mixture which comprises water vapor, portions of natural gas that were entrained in the liquid hydrocarbons, and components of the liquid hydrocarbons which have flashed and have changed state from a liquid to a gas. The first body of homogenous gas mixture exits intermediate pressure 10 at exit 26 and flows through line 28 to the inlet 30 of emissions separator 32. The length of flow line 28 varies from location to location and in most cases, but not always, it is installed above ground. During winter, line 28 may be exposed to low ambient temperatures which could cool the first body of homogenous gas mixture flowing in line 28 to a temperature in which the gaseous liquid hydrocarbons and water vapor contained in the first body of homogenous gas mixture could begin to change state from a gas to a liquid. It is desirable that none of the gases contained in the first body of homogeneous gas mixture change state from a gas to a liquid. The presence of any free water in flow line 28 as a result of water vapor condensing from the first body of homogeneous gas mixture would pose a risk of ice forming in flow line 28 thus blocking the flow in line 28 of the first body of homogeneous gas mixture.

Several types of gas-to-gas heat exchangers can be used to provide heat to the first body of homogenous gas mixture flowing in line 28. The gas-to-gas heat exchangers exchange the heat (e.g., between 225 and 300 degrees Fahrenheit) contained in the hot discharge gas flowing in line 36 with the first body of homogeneous gas mixture flowing in line 28 thus raising the temperature of the gas flowing in line 28.

Both flow lines 28 and 36 may be field installed and connect the vapor processing system to the inlet of inline separator 1 and the outlet of intermediate separator 10 which are in close proximity to each other. One type of heat exchange that may be used is to field lay lines 28 and 36 so that they touch each other, and the two lines are may be insulated with heat resistant insulation. The heat of compression (e.g., 250 to 300 degrees Fahrenheit) from flow line 36 provides heat along the entire length of line 28 to substantially prevent some of the gases contained in the first body of homogenous gas mixture from changing state from a gas to a liquid, and the heat from flow line 36 prevents freezing of any water vapor that might condense in flow line 28.

The first body of homogenous gas mixture flowing in line 28 enters emissions separator 32 at inlet 30. Emissions separator 32 is approximately half full of ethylene glycol (other appropriate liquids or mixture of liquids can also be used). The purpose of the body of ethylene glycol contained in emissions separator 32 is described below. The first body of homogeneous gas mixture entering emissions separator 32 from intermediate pressure separator 10 mixes with the higher BTU fourth body of homogeneous gas mixture collected from the tanks and forms a second body of homogenous gas mixture (collection of the tank gases is described below). Any liquids that might condense from the collected second body of homogeneous gas mixture will separate from the gas and be dumped through motor valve 46 (motor valve 46 is controlled by a liquid level controller (not shown)) and flow line 48 into storage tank 24. The collected second body of homogeneous gas mixture exits emissions separator 32 at outlet 38. The collected second body of homogeneous gas mixture at approximately 27 psig flows through lines 41 and 40 to the suction 42 of reciprocating compressor 34. Reciprocating compressor 34 compresses the collected gases up to a pressure range of, for example, approximately 125 to 250 psig. The discharge pressure of reciprocating compressor 34 is determined by the pressure of the flowing gas stream contained in inline separator 1. From the discharge port 44 of reciprocating compressor 34, the collected second body of homogeneous gas mixture flows through line 71 to point 72. At point 72, line 71 divides to form lines 74 and 36. Line 74 terminates at pressure regulator 76. Pressure regulator 76 is set at approximately 27 psig to maintain a near-to-constant suction pressure at suction port 42 of reciprocating compressor 34. Compressor 34 is sized to compress more gas than the volume of gas entering line 40 from emissions separator 32. Any time the suction pressure at suction port 42 drops below the set point of pressure regulator 76, gas flows from pressure regulator 76 through line 78 to inlet 79 on emissions separator 32 to maintain a near-to-constant pressure at suction port 42. From point 72, the collected second body of homogeneous gas mixture flows through line 36 to point 142. From point 142, the second body of homogeneous gas mixture flows through line 3 to the inlet 2 of inline separator 1. In inline separator 1, the collected higher BTU second body of homogeneous gas mixture from line 36 mixes with the larger volume lower BTU gases flowing through inline separator 1 and forms a third body of homogeneous gas mixture.

Referring again to FIG. 1, and as previously described herein, the liquid hydrocarbons, from intermediate pressure separator 10 flow through motor valve 88 and line 20 and enter storage tank 24 at inlet 22. The liquids from separator 10 flash to form a fourth body of homogenous gas mixture as a result of the pressure change from the pressure in intermediate separator 10 to the near or atmospheric pressure in storage tank 24. In addition to the immediate flash, the liquid hydrocarbons contained in tank 24 continue to evolve gases as the liquid hydrocarbons attempt to reach equilibrium with the gases contained in tank 24. The fourth body of homogenous gas mixture of flash and evolved gases exit storage tank 24 at outlet 50. The fourth body of homogeneous gas mixture from storage tank 24 flows through lines 51, back pressure regulator 53, line 52, line 55, and line 57 to the vacuum inlet 54 of eductor 56.

Eductor 56 is powered by ethylene glycol or other appropriate fluid that is pumped from emissions separator 32 by circulation pump 58. The ethylene glycol exits emissions separator 32 at fluid outlet 60. The ethylene glycol (at, for example, approximately 27 psig) flows through line 64 to suction inlet 62 of circulation pump 58. Circulation pump 58 increases the pressure of the ethylene glycol to approximately 120 psig. The pressurized ethylene glycol exits circulation pump 58 at discharge port 66 and flows through line 68 to power port 61 of eductor 56. While flowing through eductor 56, the pressurized ethylene glycol powers eductor 56 to create a vacuum at vacuum port 54. The vacuum generated by eductor 56 is controlled to a few inches of water column (e.g., 3 to 12 inches) by a vacuum controller such as, for example, a model 12 PDSC supplied by Kimray, Inc. Vacuum controller 82 is connected to line 52 at point 81. Vacuum controller 82 outputs a throttling pressure signal to normally opened motor valve 88. Normally opened motor valve 88 is installed at the termination of line 86. Line 86 begins at point 84 at the end of line 41 and terminates at the inlet of normally opened motor valve 88. Normally opened motor valve 88 is connected by line 90 to line 55 at point 92. When the vacuum at point 81 exceeds the set point of vacuum controller 82, vacuum controller 82 decreases the output pressure to normally open motor valve 88. The decrease of output pressure to normally opened motor valve 88 causes normally opened motor valve 88 to partially open thereby increasing the flow of gas from emissions separator 32 through line 86, motor valve 88, and line 90 into line 55. Increasing or decreasing the volume of gas flowing from emissions separator 32 to vacuum port 54 of eductor 56 maintains the desired vacuum in line 52.

The fourth body of homogeneous gas mixture from storage tank 24 is drawn into eductor 56 through line 51, back-pressure regulator 53, line 52, line 55, and line 57 by the vacuum created by eductor 56. To prevent air entering the system, back-pressure regulator 53 holds a positive pressure of approximately 8 ounces per square inch above atmospheric pressure on tank 24. The collected fourth body of homogenous gas mixture is drawn into eductor 56 through vacuum port 54 and is entrained into the flowing ethylene glycol and compressed to a pressure of, for example, approximately 27 psig contained in emissions separator 32. The ethylene glycol and the entrained and compressed fourth body of homogenous gas mixture exit eductor 56 at port 68 and flow through line 70 to inlet 72 of emissions separator 32. In emissions separator 32, as previously described, the collected fourth body of homogenous gas mixture from storage tank 24 mixes with the first body of homogenous gas mixture from intermediate pressure separator 10 and forms a second body of homogeneous gas mixture. The ethylene glycol separates from the entrained gases and falls toward the bottom of emissions separator 32. The ethylene glycol discharged by eductor 56 joins the body of ethylene glycol contained in the approximate bottom two-thirds of emissions separator 32. The ethylene glycol is continuously circulated in a closed loop by circulation pump 62 to provide power to eductor 56.

Heat is generated by the pumping of the ethylene glycol as well as the compression of the collected gases. It is desirable to control the temperature of the ethylene glycol to, for example, between approximately 100 and 120 degrees Fahrenheit. Forced draft cooler 101 provides cooling for the ethylene glycol. Forced draft cooler 101 is connected to circulating pump 58 discharge line 68 at point 94. Line 96, hand valve 98, line 97, thermostatically controlled mixing valve 102, and line 100 connect inlet 99 of forced draft cooler 101 to point 94. Outlet 103 of forced draft cooler 101 is connected by line 105 and line 104 to emissions separator 32 at point 106.

A side stream of ethylene glycol under pressure from circulating pump 58 flows through forced draft cooler 101 and returns to emissions separator 32 thus cooling the ethylene glycol. The volume of ethylene glycol (e.g., 3 to 6 gallons per minute) flowing in the side stream is controlled by adjusting hand valve 98. To maintain the desired temperature of the ethylene glycol of between 100 and 120 degrees Fahrenheit, thermostatically controlled mixing valve 102 can bypass through line 107 a part of, or the entire side stream of, ethylene glycol. Whenever the ethylene glycol becomes too cold, thermostatically controlled mixing valve 102 reduces the volume of the side stream flowing through forced draft cooler 101.

Figure 2:
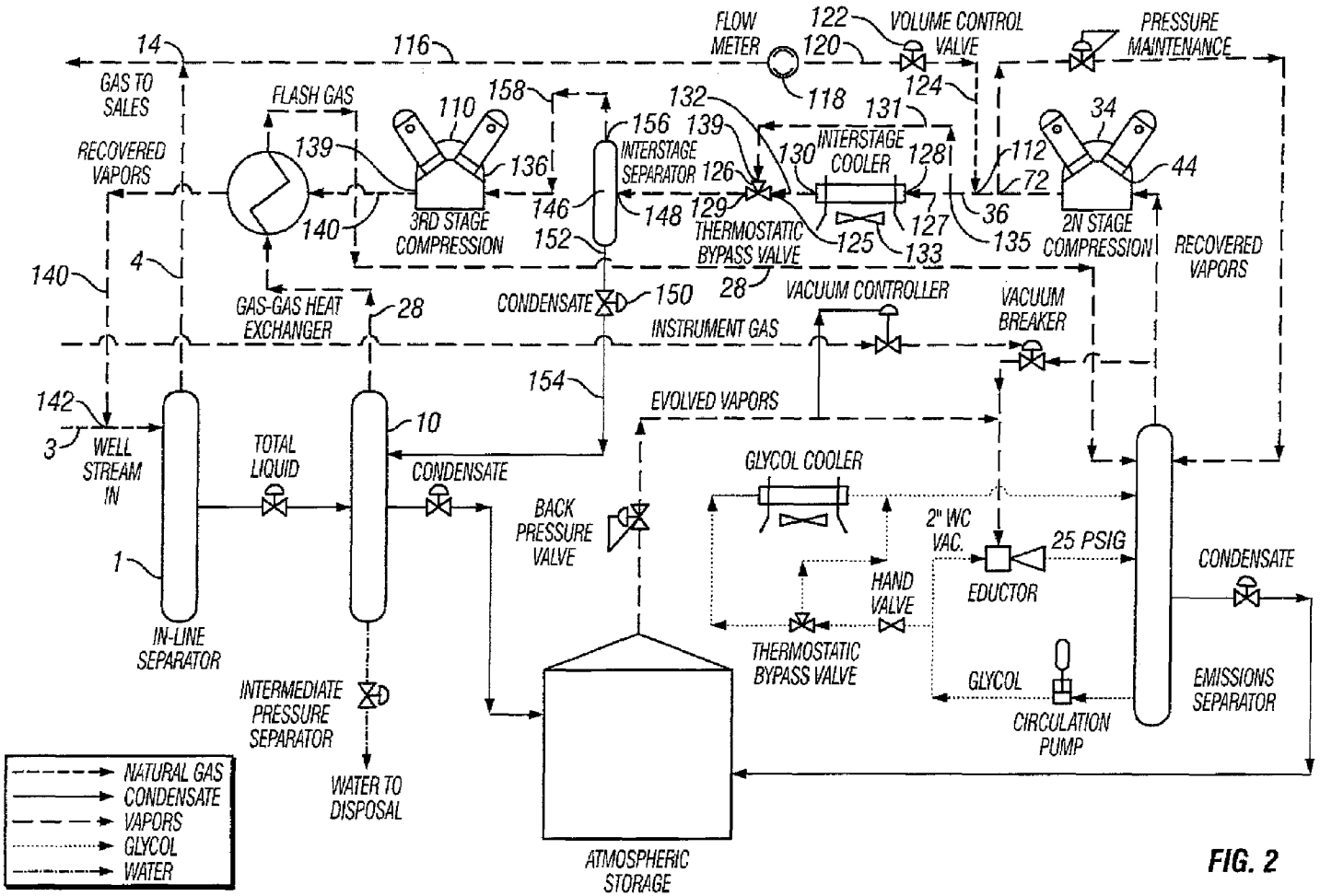
FIG. 2 is a flow diagram of a modification of the embodiment of FIG. 1.

FIG. 2 is a flow diagram of the embodiment wherein the temperature between stages of compression of the homogenous gas mixture is controlled to maintain the suction temperature of each stage of compression. As noted above, the embodiment shown in FIG. 2 is intended for applications where the flowing gas pressure is elevated to pressures above, for example, 250 psig and where the changing of liquid hydrocarbon vapors back from a gas to a liquid state creates recycle loops.

All of the components described in FIG. 1 are incorporated into FIG. 2 and only the components of FIG. 1 required to explain the modifications shown in FIG. 2 are described detail below.

As shown in FIG. 2, a third stage of compressor 110 is added to receive the discharge gas from second stage compressor 34. The hot (e.g., 225 to 300 degrees Fahrenheit), compressed, and collected second body of homogeneous gas mixture exits compressor 34 at discharge port 44 and flows to point 72. From point 72, the hot, compressed, and collected second body of homogeneous gas mixture flows through line 36 to point 112 where a side stream of sales gas from inline separator 1 enters line 36 and mixes with the hot, compressed, collected second body of homogenous gas mixture forming a fifth body of homogeneous gas mixture. The volume of gas from inline separator 1 that enters line 36 at point 112 increases the total volume of gas passing through point 112 by approximately 5% to 10%. The side stream of gas flows from inline separator 1 through line 4 to point 114. From point 114, the side stream of gas flows through line 116, flow meter 118, line 120, flow control valve 122, and line 124 to point 112. Flow control valve 122 is controlled by a PLC or other flow control device (not shown) to allow the required volume of side stream gas from inline separator 1 to increase the volume of gas flowing through point 112 by, for example, approximately 5% to 10%.

As described above, mixing a lower BTU and vapor pressure gas with a higher BTU and vapor pressure gas reduces the tendency of some of the components of the higher BTU gas to change state from a gas to a liquid thereby reducing the chance of recycle loops forming.

From point 112, the fifth body of hot homogeneous gas mixture flows through line 127 to inlet 128 of forced draft cooler 133. While flowing through forced draft cooler 133 the gases are cooled to an approximately 20 degrees Fahrenheit approach to ambient temperature. The cooled gases exit forced draft cooler 133 at outlet 130 and flow through line 132 to cool gas inlet port 125 of thermostatic bypass valve 126. Thermostatic bypass valve 126 monitors the temperature of the gas flowing out of outlet 129 into line 134. When the gas temperature exiting outlet port 129 of thermostatic bypass valve 126 drops to approximately 120 degrees Fahrenheit, thermostatic bypass valve 126 begins to bypass some of the hot gas around cooler 133. The hot gas flows from point 135 through bypass line 131 to hot gas inlet port 139 of thermostatic bypass valve 126. The hot gas from hot gas inlet port 139 mixes in thermostatic bypass valve 126 with the cooled gas from cool gas inlet port 125 thereby maintaining the gas temperature in line 134 at approximately 120 degrees Fahrenheit. Keeping the gas in line 134 at approximately 120 degrees Fahrenheit prevents most of the liquid hydrocarbon condensation that might occur at a cooler temperature in line 134 or separator 146.

The approximately 120 degrees Fahrenheit temperature fifth body of homogeneous gas mixture enters separator 146 at inlet 148. Separator 146 removes any liquids that may have resulted from a phase change from a gas to liquid after the fifth body of homogenous gas mixture is compressed and cooled. The liquids separated in separator 146 are dumped by motor valve 150 (motor valve 150 is actuated by a liquid level controller not shown) through lines 152 and 154 into intermediate pressure separator 10. As described above, some of the gases and liquids contained in the liquid from separator 146 will flash. The balance of the liquids from separator 146 will drop to the bottom of intermediate pressure separator 10 and mix with the liquids from inline separator 1. The overall operation of intermediate separator 10 has been described above.

The fifth body of homogenous gas mixture in separator 146 exits at outlet 156 of separator 146 and flows through line 158 to enter third stage compressor 110 at suction port 136. Third stage compressor 110 compresses the fifth body of homogenous gas mixture to the pressure of the flowing gas stream.

From discharge port 139 of third stage compressor 110, the gas flows through line 140 (as previously described, line 140 is installed to be in heat exchange relationship with line 28 from intermediate pressure separator 10) to point 142. At point 142, the fifth body of homogenous gas mixture enters line 3 and mixes with the flowing gas stream to form, in inline separator 1, the previously described third body of homogeneous gas mixture. The function of inline separator 1, as well as the function of the rest of the process, has been described above.

The embodiments described herein have been shown utilizing only three stages of compression (the eductor and two stages of compression). However, it should be understood that other embodiments of the present invention can incorporate more than three stages of compression. Also, it should be understood that mixing gases of different BTU's in relation to each other (i.e., a lower BTU gas with a higher BTU gas such as a lower molecular gas such as methane with a higher molecular weight gas such as butane) can be done between any stage of compression (or at any point in the system). Thus, such a mixing of gases can be performed between the first and second stages and/or between the second and third stages of compression shown in FIG. 2.

There is the potential in cold climates of gas hydrates forming in volume control valve 122 and motor valve 150 (hydrates are an ice-like substance that can form from natural gas when the proper temperature, pressure, and water content are present). Where needed, the potential of hydrates forming in the system can be eliminated by installing a gas-to-gas heat exchanger upstream of volume control valve 122 and a gas-to-liquid heat exchanger upstream of motor valve 150. The hot gas for both exchangers can be the hot discharge gas from compressor 34.

The preceding examples can be repeated with similar success by substituting the generically or specifically described compositions, biomaterials, devices and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above, and of the corresponding application(s), are hereby incorporated by reference.

What is claimed is:

1. A method for preventing the release of natural gas at a natural gas well processing system from being released to the atmosphere, the method comprising:

creating a vacuum with an eductor for collecting evolved gases from a liquid hydrocarbon storage tank which comprises a capacity of at least 200 barrels while maintaining a positive pressure on the storage tank;

entraining the evolved gases into a liquid glycol stream;

compressing the evolved gases and liquid glycol stream;

sending the evolved gases and liquid glycol stream to an emissions separator; and separating the gases from the liquid glycol for further processing.

2. The method of claim 1 further comprising mixing a first compressed gas with a second compressed gas flowing in a pipeline, the second compressed gas having a BTU lower relative to the BTU of the first compressed gas to prevent gaseous hydrocarbons in a natural gas well processing system from entering a liquid state.

3. A natural gas well processing system comprising:

a hydrocarbon storage tank, said storage tank comprising a capacity of at least 200 barrels;

an eductor linked to said storage tank, said eductor creating a vacuum to receive gases that evolve in the storage tank, entraining said gases into a liquid glycol stream and compressing said gases and said liquid glycol stream while maintaining a positive pressure on said storage tank with a back-pressure regulator; and an emissions separator linked to said eductor for receiving said evolved gases and liquid glycol stream for separation of said gases from the liquid glycol stream and for sending said gases out of said emissions separator for further processing.

4. A method for preventing the release of natural gas at a natural gas well processing system from being released to the atmosphere, the method comprising:

creating a vacuum with an eductor, powered by a flow of a liquid glycol stream for collecting evolved gases from a liquid hydrocarbon storage tank which comprises a capacity of at least 200 barrels while maintaining a positive pressure on the storage tank with a back-pressure regulator;

entraining the evolved gases into a liquid glycol stream;

compressing the evolved gases and liquid glycol stream;

sending the evolved gases and liquid glycol stream to an emissions separator; and separating the gases from the liquid glycol for further processing.

5. The method of claim 4 further comprising mixing a first compressed gas with a second compressed gas flowing in a pipeline, the second compressed gas having a BTU lower relative to the BTU of the first compressed gas to prevent gaseous hydrocarbons in a natural gas well processing system from entering a liquid state.

6. A natural gas well, processing system comprising:

a hydrocarbon storage tank which comprises a capacity of at least 200 barrels;

an eductor linked to said storage tank, said eductor creating a vacuum to receive gases that evolve in the storage tank by powering the eductor with a flow of liquid glycol, entraining said gases into a liquid glycol stream and compressing said gases and said liquid glycol stream while maintaining a positive pressure on said storage tank with a back-pressure regulator; and an emissions separator linked to said eductor for receiving said evolved gases and liquid glycol stream for separation of said gases from the liquid glycol stream and for sending said gases out of said emissions separator for further processing.

* * * * *